US006153273A

United States Patent [19]

Lee Lin

[11] Patent Number: 6,153,273

[45] Date of Patent: Nov. 28, 2000

[54] BUBBLE-PRODUCING ORNAMENT

[75] Inventor: Yunn-Fen Lee Lin, Taipei, Taiwan

[73] Assignee: Vincent K. Lee, Taipei, Taiwan

[21] Appl. No.: 09/335,481

[22] Filed: Jun. 18, 1999

[51] Int. Cl.[7] ..... G09F 19/00

[52] U.S. Cl. ..... 428/13; 40/406; 40/409

[58] Field of Search ..... 428/13, 98; 40/406, 40/409, 439, 477

*Primary Examiner*—Alexander S. Thomas
*Attorney, Agent, or Firm*—Bacon & Thomas, PLLC

[57] ABSTRACT

A bubble-producing ornament having a clear liquid container connected to a seat and a vertically extended tube and a downward extended path outside the tube being provided inside the container. The tube has a lower end always facing an upward opened conic area provided on a bottom of the container to gather a plurality of balls therein. An air nozzle is connected to the lowest central portion of the conic area so that compressed air can be supplied from an air pump to blow out via the air nozzle to produce bubbles and force the balls in the conic area to sequentially move upward along the tube. When the balls move out of the top of the tube, they roll along the path outside the tube to finally move back to the conic area again. The balls are then sent upward again by the compressed air in a circular manner. The moving balls together with the bubbles create a dynamic and changeful sight in the ornament.

4 Claims, 5 Drawing Sheets

BUBBLE-PRODUCING ORNAMENT

BACKGROUND OF THE INVENTION

With the quick development in the commercial and industrial field and the increasingly high requirements of people toward their living quality, general consumers pay more attention to the cost and the unique structural design of articles they select to purchase. Taking general indoor ornaments as an example, such as desktop liquid ornaments, they usually include a clear outer container connected to a seat for containing one or two types of liquid and floating decorative items therein. However, to attract more consumers, designers of such liquid ornaments must break through the almost unchanged old structure of the conventional liquid ornaments described above.

It is therefore tried by the inventor to develop a novel bubble-producing ornament that possesses not only the features of conventional bubble-producing ornaments, such as emitting light and containing liquid and movable decorative items in the liquid, but also some other unique features that have never been found in the conventional liquid ornaments.

SUMMARY OF THE INVENTION

A primary object of the present invention is to provide a bubble-producing ornament that includes a container having a suitable type of liquid and a plurality of suitable balls contained therein. The balls are forced by compressed air blown toward them to sequentially move upward through a tube vertical extended in the container and then roll along a downward extended path outside the tube until they reach a lower end of the tube. The balls are then sent upward in the tube again by the compressed air in a circular manner. Meanwhile, numerous bubbles are produced when the compressed air is pumped into the liquid in the container together with the moving balls form a unique scene.

Another object of the present invention is to provide a bubble-producing ornament into which a certain suitable type of liquid can be filled and drained at any time for cleaning purpose, so that the ornament always has clean and clear liquid to present a beautiful and pleasant dynamic sight.

A further object of the present invention is to provide a bubble-producing ornament that is so structured that liquid can be filled thereinto at a time just before starting to use the ornament, so that the ornament can be easily and safely stored and transported at a reduced weight and cost.

To achieve the above and other objects, the present invention provides a bubble-producing ornament including a hollow container for containing a certain type of liquid, a seat connected to a lower end of the container, a removable cap covering an upper end of the container, and a plurality of balls disposed in the container. The balls have a specific gravity higher than that of the liquid selected for filling the hollow container. A vertically extended tube and a downward extended path outside the tube are provided inside the container. The tube has a lower end always facing an upward opened conic area provided at a bottom of the container for gathering the balls therein. An air nozzle, an air pump, and a check valve between the nozzle and the pump are mounted in the seat. The air nozzle is located at the lowest central portion of the conic area, so that balls gathered in the conic area are forced by compressed air supplied from the air pump and blown out via the air nozzle to sequentially move upward in the vertical tube and then roll down along the path outside the tube into the conic area again due to gravity.

Such upward moving and downward rolling of the balls inside and outside the vertical tube within the container continues in a circular manner and creates unique, changing, dynamic sights in the ornament.

DETAILED DESCRIPTION OF THE PREFERRED EMBODIMENTS

Figure 1:
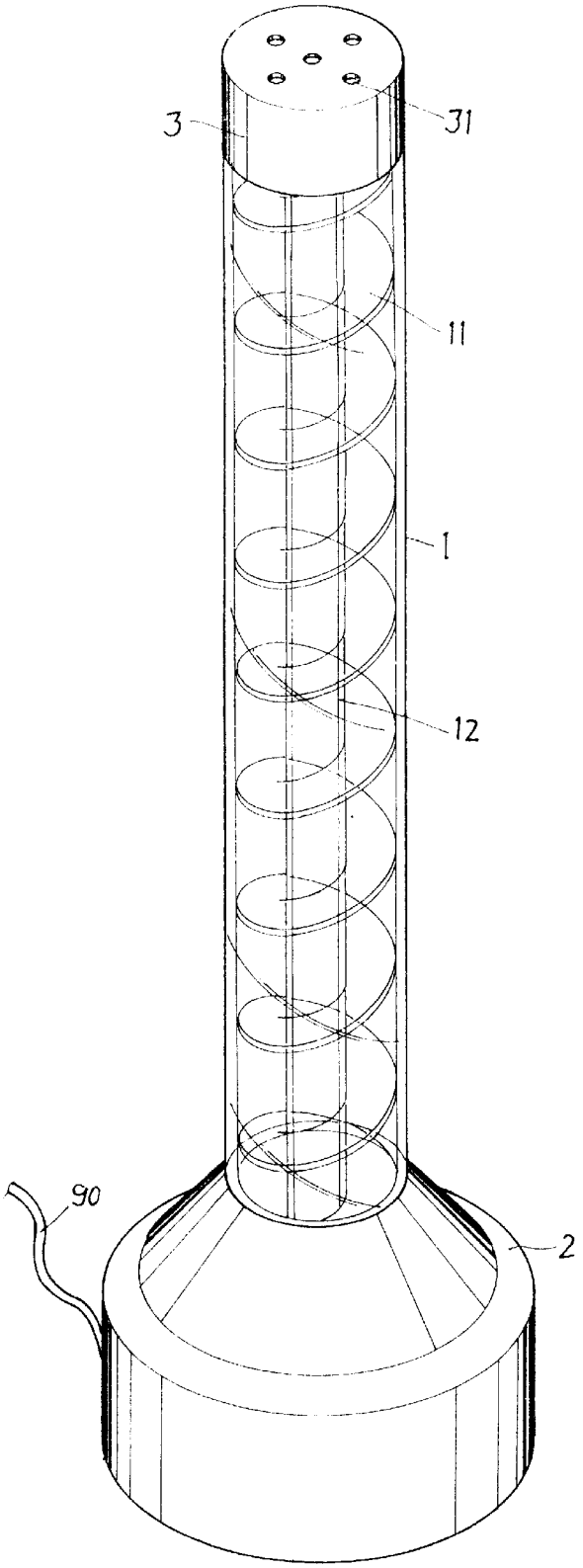
FIG. 1 is a perspective of a bubble-producing ornament according to a preferred embodiment of the present invention.
Figure 2:
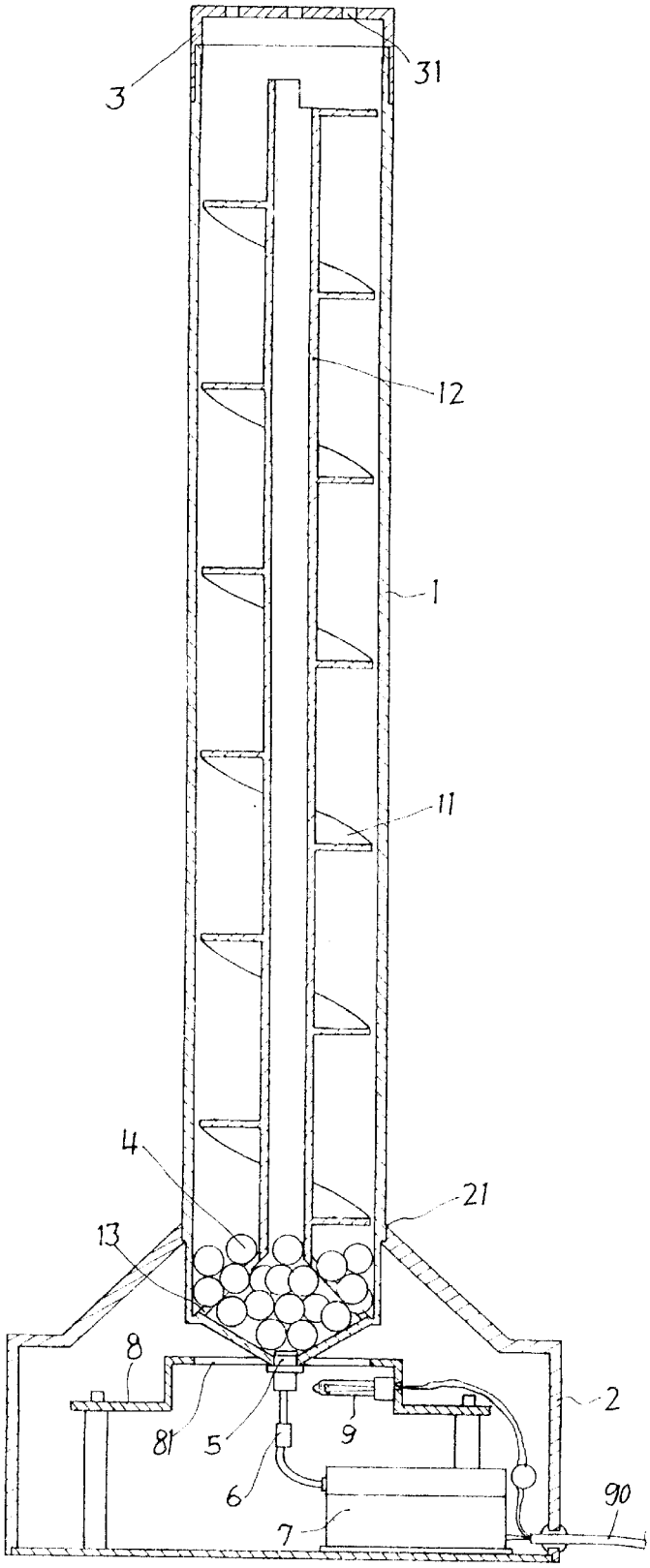
FIG. 2 is a vertical sectional view of the bubble-producing ornament of FIG. 1.

Please refer to FIGS. 1 and 2 in which a bubble-producing ornament according to a preferred embodiment of the present invention is shown. The bubble-producing ornament is formed of a hollow container 1, a seat 2 connected to a lower end of the container 1, a removable cap 3 covering an upper end of the container 1, and a plurality of balls 4 disposed in the container 1.

The hollow container 1 is preferably made of a transparent material and has an open upper end closed by the cap 3. The hollow container 1 is so designed that it has a vertically extended spiral path 11 integrally formed therein. A central portion of the vertically extended spiral path 11 is a tube 12 defining a vertical passage. The central tube 12 has ribs 13 radially extended from a periphery of its lower end to connect to a lower periphery of the hollow container 1. The ribs 13 are suitably spaced from one another so that the balls 4 can easily pass through the space between two adjacent ribs 13. The hollow container 1 has a conic lower end and therefore provides a beveled bottom surface. With the beveled bottom surface, the balls 4 passing through the ribs 13 would naturally fall and gather at the lowest central portion of the conic lower end of the container 1.

The seat 2 defines a hollow inner space and has a top opening 21 for the lower end of the hollow container 1 to insert into and be fitly supported on the seat 2. An air pump 7 is mounted inside the seat 2 on a bottom thereof. An air nozzle 5 is distantly connected to the air pump 7 to locate below a central opening on the conic bottom of the hollow container 1. The air nozzle 5 is formed of a plurality of through holes via which compressed air supplied by the air pump 7 is forced out. A check valve 6 is connected between the air nozzle 5 and the air pump 7 to prevent compressed air supplied to the air nozzle 5 from flowing backward. Moreover, a support 8 is provided in the seat 2 and screwed thereto for supporting a light-emitting means 9. An opening 81 is provided on a top surface of the support 8, so that light emitted by the light-emitting means 9 may project onto the hollow container 1 via the opening 81. A supply cord 90 is connected at one end to the seat 2 for supplying required power to the air pump 7 and the light-emitting means 9, and at the other end to an external power source (not shown).

The cap 3 may be screwed or simply covered onto the upper end of the hollow container 1. Through holes 31 may be optionally provided on the cap 3. Moisture inside the liquid-loaded container 1 may diffuse from the container 1 into open air via the through holes 31. In a dry area, such diffusion of moisture is helpful in adjusting the relative humidity of surrounding environment.

The ball 4 is made of a material having a specific gravity higher than that of the liquid loaded in the container 1, so that the balls 4 naturally move downward along the spiral path 11 in the liquid-loaded container 1 under gravity.

Figure 3:
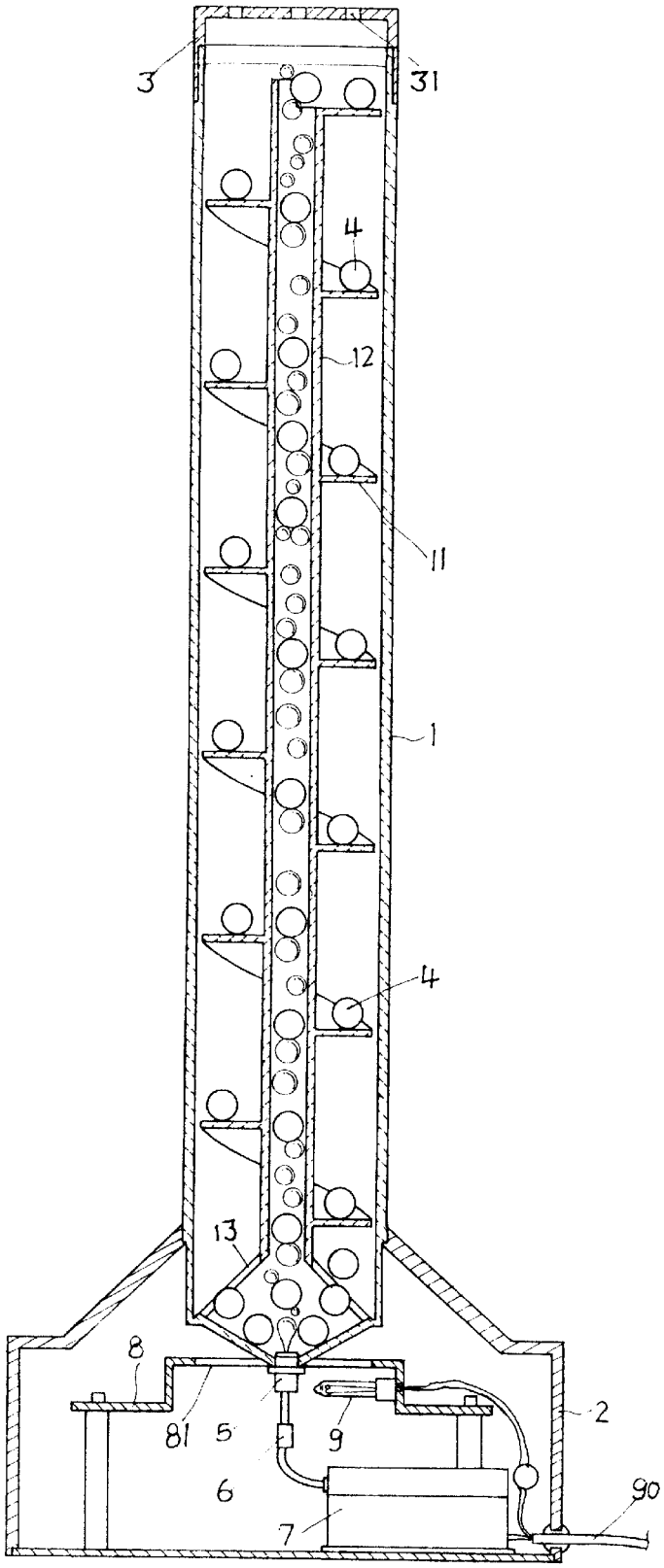
FIG. 3 is a vertical sectional view showing the bubble-producing ornament of FIG. 1 is fully loaded with liquid and continuous bubbles are produced in the ornament.
Figure 4:
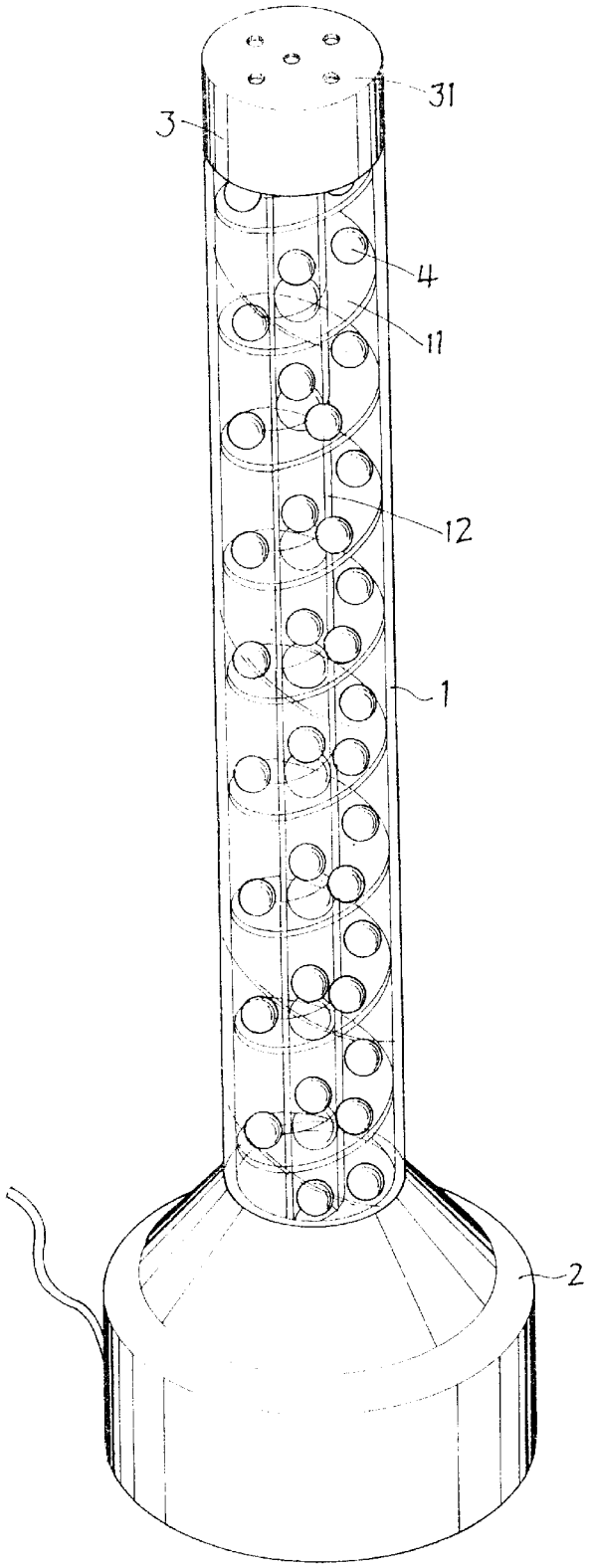
FIG. 4 is a perspective of the liquid-loaded bubble-producing ornament of FIG. 3.

About the use and operation of the present invention, please refer to FIGS. 2, 3 and 4 at the same time. The hollow container 1 is empty without any liquid (as shown in FIG. 2) when the bubble-producing ornament of the present invention is produced. This would advantageously reduce the weight of the ornament for convenient storage and transport. A consumer receiving the ornament needs only to remove the cap 3 from the upper end of the empty container 1 and fill water or other predetermined liquid into the container 1 and replace the cap 3.

Figure 5:
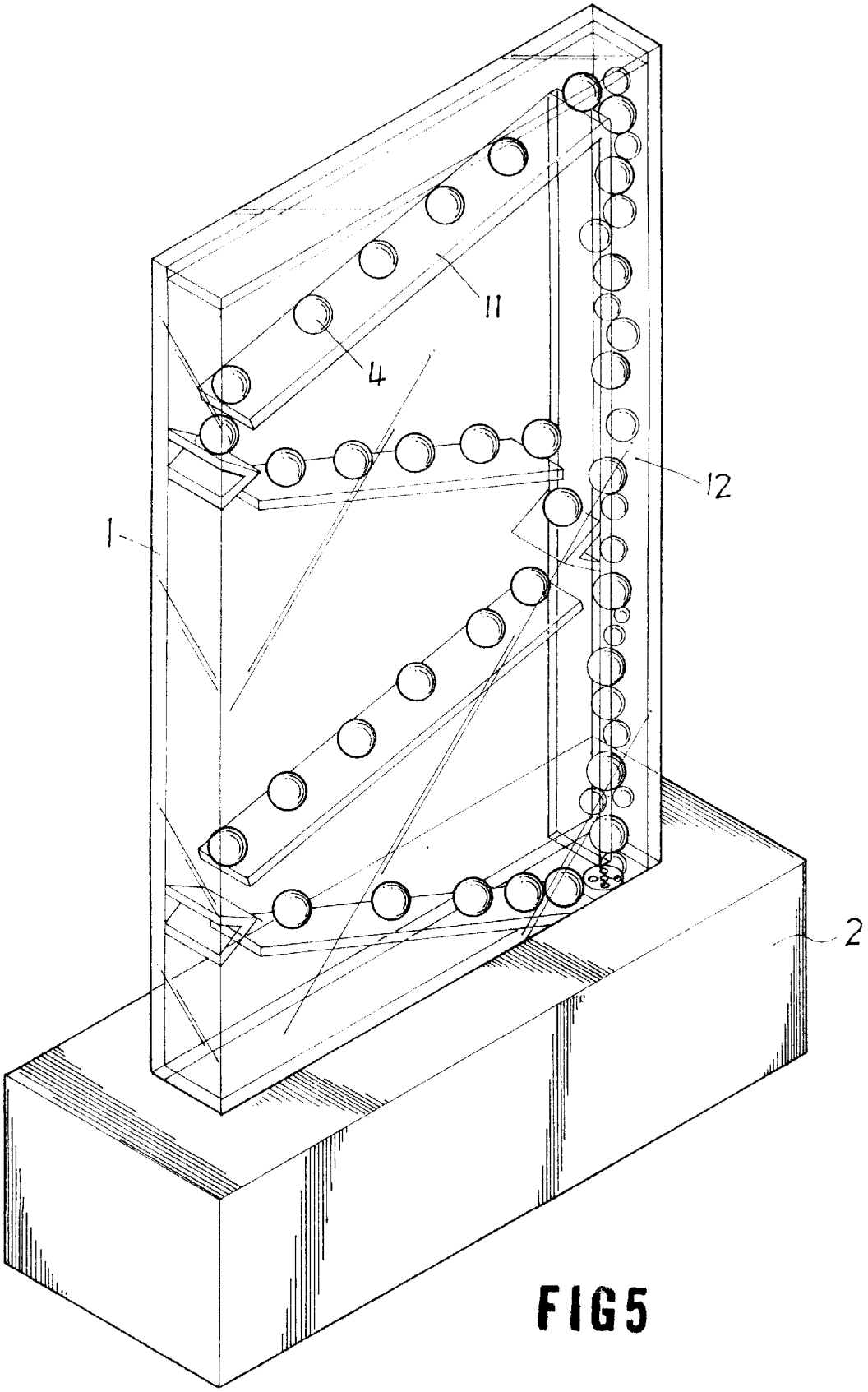
FIG. 5 is a bubble-producing ornament according to another embodiment of the present invention.

After the container 1 is fully filled with liquid and the supply cord 90 is connected to an external power source, the air pump 7 may be turned on to supply compressed air to the air nozzle 5. The compressed air is continuously forced upward into the liquid-loaded container 1 via the through holes on the air nozzle 5, pushing the balls 4 gathered at the beveled bottom surface of the container 1 to sequentially move upward through the central tube 12. Meanwhile, numerous bubbles are produced in the container 1. When the balls 4 reach and pass over an upper open end of the central tube 12, they fall onto a top surface of the spiral path 11 due to gravity. The balls 4 would then sequentially roll down along the spiral path 11 one by one until they reach a lower end of the spiral path 11 and pass through the ribs 13 to gather at the beveled bottom surface of the container 1 above the air nozzle 5 again. The balls 4 keep being sent upward into the central tube 12, rolling down along the spiral path 11, and gathering at the beveled bottom surface of the container 1 in a circular manner while bubbles are continuously produced. This circular movement of balls 4 in the container 1 together with the continuous bubbles creates a dynamic, eye-catching scene in the small bubble-producing ornament of the present invention. What is to be noted is the creation of such unique, dynamic, and beautiful scene in the bubble-producing ornament is not necessary limited by the shape of the container 1 or the configuration of the path 11. For example, the container 1 is not necessarily a circular body as that shown in FIGS. 1 to 4. Instead, a rectangular container 1 as shown in FIG. 5 or any other differently shaped container may also be accepted. Similarly, the path 11 is not necessarily a spiral path as that shown in FIGS. 1 to 4 but can be a stair-like structure as shown in FIG. 5. Moreover, the air nozzle 5 is not limited to only one in number. Two or more air nozzles 5 may be arranged to form multiple air outlets in the container 1, so that the production of bubbles and the movement of balls 4 in the container 1 are more changeful.

What is claimed is:

1. A bubble-producing ornament comprising a transparent hollow container, a seat connected to a lower end of said container, a removable cap covering an upper end of said container, and a plurality of balls disposed inside said container; said container being characterized in that at least one vertically extended through tube is provided therein, said through tube being provided around a lower outer periphery with at least one space large enough for said balls to sequentially pass therethrough, and said through tube facing an upward opened conic area provided on a bottom of said hollow container, whereby said balls in said container passing through said lower space around a lower outer periphery of said through tube always roll downward to gather in said conic area; and each said conic area having an air nozzle connected to a lowest central portion thereof, said air nozzle being distantly connected to an air pump mounted in said seat, so that compressed air is supplied from said air pump to said air nozzle, and a check valve being connected between said air nozzle and said air pump to prevent the compressed air supplied to said air nozzle from flowing backward, whereby when the compressed air supplied from said air pump to blow out via each said air nozzle, said balls gathered in said conic area are forced to sequentially move upward along said through tube until said balls reach and pass over an open upper end of said through tube.

2. A bubble-producing ornament as claimed in claim 1, wherein a ball rolling path is provided outside said through tube, said ball rolling path starting from said upper open end of said through tube and ending at said lower outer periphery of said through tube to connect to said conic area below each said through tube.

3. A bubble-producing ornament as claimed in claim 1, wherein said balls have a specific gravity larger than that of a liquid filled in said hollow container.

4. A bubble-producing ornament as claimed in claim 3, wherein said liquid filled in said hollow container has a level higher than said upper open end of said through tube.

* * * * *